US011357309B2

(12) United States Patent
Shen

(10) Patent No.: US 11,357,309 B2
(45) Date of Patent: Jun. 14, 2022

(54) ENVIRONMENTALLY FRIENDLY COSMETIC CASE

(71) Applicant: APR Beauty Group Inc., Toronto (CA)

(72) Inventor: Jun Shen, New Westminster (CA)

(73) Assignee: APR BEAUTY GROUP INC., Toronto (CA)

( * ) Notice: Subject to any disclaimer, the term of this patent is extended or adjusted under 35 U.S.C. 154(b) by 322 days.

(21) Appl. No.: 16/582,567

(22) Filed: Sep. 25, 2019

(65) Prior Publication Data

US 2021/0085059 A1 Mar. 25, 2021

(30) Foreign Application Priority Data

Aug. 19, 2019 (CN) ..... CN201921339865

(51) Int. Cl.
*A45D 40/24* (2006.01)
*A45D 40/02* (2006.01)
*A45D 40/22* (2006.01)

(52) U.S. Cl.
CPC ..... *A45D 40/24* (2013.01); *A45D 40/023* (2013.01); *A45D 40/222* (2013.01); *A45D 2040/225* (2013.01)

(58) Field of Classification Search
CPC ..... A45D 33/00; A45D 40/22; A45D 40/221; A45D 40/222; A45D 40/224; B65D 43/22; B65D 43/162; B65D 43/169; B65D 2251/1041; B65D 2251/105; B65D 2251/1025; B65D 2251/1033; B42D 3/02; B42D 3/08; F16B 12/26; F16B 12/088; F16B 12/086
See application file for complete search history.

(56) References Cited

U.S. PATENT DOCUMENTS 5,037,000 A * 8/1991 Selame ..... B65D 43/162 221/303
5,274,887 A * 1/1994 Fudaki ..... F16G 15/08 24/265 H
2013/0216740 A1* 8/2013 Russell-Clarke ..... B23K 26/38 428/33
2019/0110578 A1* 4/2019 Maurin ..... A45D 40/22

* cited by examiner

*Primary Examiner* — David P Angwin
*Assistant Examiner* — Bradley S Oliver

(57) ABSTRACT

Disclosed is an environmentally friendly cosmetic case, comprising a holder and a case cover for covering the holder, wherein the case cover comprises a connecting portion, an elastic portion and a covering portion which are sequentially arranged; the elastic portion can be elastically deformed, and the connecting portion and the covering portion can both be reversed by the elastic portion; an upper end of the connecting portion is connected to a bottom end of the holder, and the covering portion is used to cover the holder; and the holder and the case cover are made of a wood or bamboo material. With the above arrangement, the cosmetic case is easily decomposed by natural microorganisms such that the cosmetic case is more environmentally friendly.

8 Claims, 3 Drawing Sheets

ENVIRONMENTALLY FRIENDLY COSMETIC CASE

TECHNICAL FIELD

The present utility model relates to the technical field of packaging cases for cosmetic articles, and in particular to an environmentally friendly cosmetic case.

BACKGROUND ART

With continuous improvement of people's living standards, people's aesthetic pursuits are increasingly higher, make-up, as a main means to improve self-image, has become an indispensable part of many women's lives.

As a kind of makeup industry, eye shadow is used for makeup around the eyes, and makes the eyes to present a stereoscopic sense with colour and shadow. The eye shadow has the form of powder, a stick, paste, emulsion or a pencil, and in the prior art, a cosmetic packaging case for containing eye shadow is mostly made of plastic, the structure thereof being generally composed of a case body and a case cover, wherein the case cover is hinged to the case body by a metal hinge, however, the above-mentioned packaging case is made of materials such as plastic and steel, so that the packaging case is not easily degraded by natural microorganisms, does not split apart in the natural environment for a long time, and will become a permanent pollutant in the environment and constantly accumulate, which will cause great harm to the environment.

SUMMARY OF THE UTILITY MODEL

An object of the present utility model is to provide an environmentally friendly cosmetic case, which is made of a wood or bamboo material to make the cosmetic case more environmentally friendly.

The above technical object of the present invention is achieved by the following technical solution: an environmentally friendly cosmetic case, comprising a holder and a case cover for covering the holder, wherein the case cover comprises a connecting portion, an elastic portion and a covering portion which are sequentially arranged; the elastic portion can be elastically deformed, and the connecting portion and the covering portion can both be reversed by the elastic portion; an upper end of the connecting portion is connected to a bottom end of the holder, and the covering portion is used to cover the holder when the cosmetic case is in a closed position; and wherein the holder is provided with a protrusion extending away from the holder and the covering portion is provided with a snap groove, and the snap groove receives the protrusion for snap engagement with the protrusion when the case cover and the holder are moved into the closed position, and wherein the protrusion has an upper groove formed at and extending inward from a distal end of the protrusion to divide the protrusion into two parts and wherein two inner inclined grooves are provided at an inner edge of the upper groove, extending inwards inside the holder and away from each other and forming together with the upper groove an inverted Y-shape, and wherein the snap groove is sized such that when the protrusion is in the snap engagement, the two parts of the protrusion are forced toward each other by the snap groove, and wherein the holder and the case cover are made of a wood or bamboo material.

Further, the two inner inclined grooves are symmetric about a center line defined by the upper groove.

Further, two sides of the protrusion are arc portions extending outwardly.

Further, there are two inclined grooves formed on each side of the protrusion in the holder, each inclined groove of the two inclined grooves being formed adjacent and spaced away from each of the two inner incline grooves and each extending away from each other.

Further, these two inclined grooves formed on each side of the protrusion are symmetrical about a center line defined by the upper groove.

Further, the elastic portion is provided with several rows of notches arranged at intervals, the notches between adjacent rows are alternately arranged, and the notches penetrate upper and lower end faces of the elastic portion.

Further, an upper end of the holder is provided with several grooves capable of holding cosmetics.

Further, when the case cover is unfolded and flattened, the connecting portion, the elastic portion and the covering portion are located on the same horizontal plane.

In summary, the present utility model has the following advantageous effects:

1. an environmentally friendly cosmetic case replaces a metal hinge structure with an elastic portion of a case cover, thereby reducing the generation of metal waste and the processing procedures of a metal hinge, and since the cosmetic case is made of a wood or bamboo material, the cosmetic case can be degraded by natural microorganisms and is more environmentally friendly, and the cosmetic case having a wooden structure or a bamboo structure can bring a high-end experience effect to consumers;

2. the elastic portion is provided with several rows of notches which are arranged at intervals and alternately, which increases the elasticity of the elastic portion, and facilitates bending the elastic portion so that a covering portion covers a holder; and 3. that arc portions extending outwardly are provided on two sides of a protrusion facilitates clamping of the protrusion to a snap groove; by providing a dividing groove, the protrusion is pressed to close when the cover is closed, and in this state, the protrusion always has an opposite acting force to clamp the snap groove; by providing inclined grooves, the elasticity of the protrusion when in clamping is effectively improved, such that the protrusion extends outwardly to come into snap engagement with the snap groove; and through the design of the arc portions, the dividing groove and the inclined grooves, it is fully ensured that during the transportation, the snap groove does not disengage from the protrusion due to vibration to cause the covering portion to automatically open, thereby protecting the content in the holder from being contaminated.

In the figures: 1. Holder; 11. Protrusion; 12. Arc portion; 13. Dividing groove; 14. Inclined groove; 15. Groove; 2.

Case cover; 21. Connecting portion; 22. Elastic portion; 221. Notch; 23. Covering portion; 231. Snap groove.

DETAILED DESCRIPTION OF EMBODIMENTS

The present utility model will be further described below in conjunction with the accompanying drawings.

Figure 1:
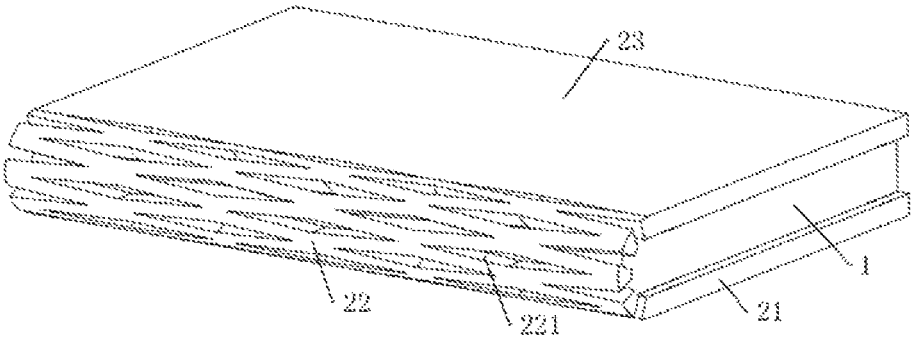
FIG. 1 is a schematic view of a wooden cosmetic case of the present utility model when it is closed.
Figure 2:
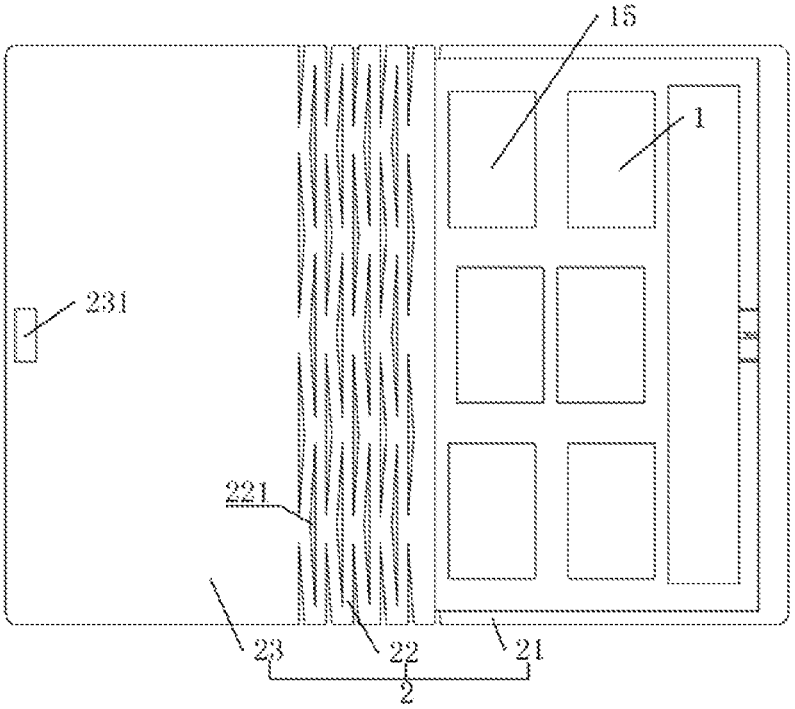
FIG. 2 is a top view of the wooden cosmetic case of the present utility model when it is unfolded.
Figure 3:
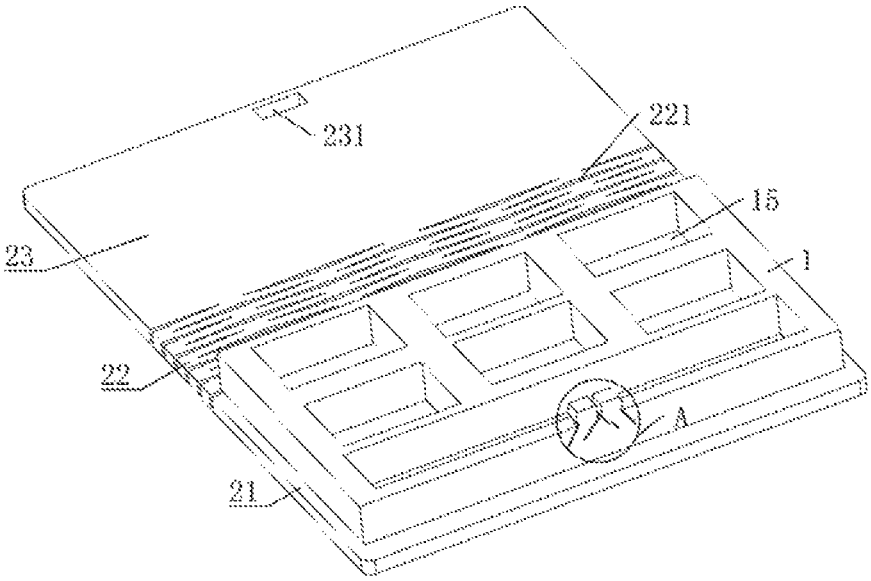
FIG. 3 is a schematic structural view of the wooden cosmetic case of the present utility model when it is unfolded.
Figure 4:
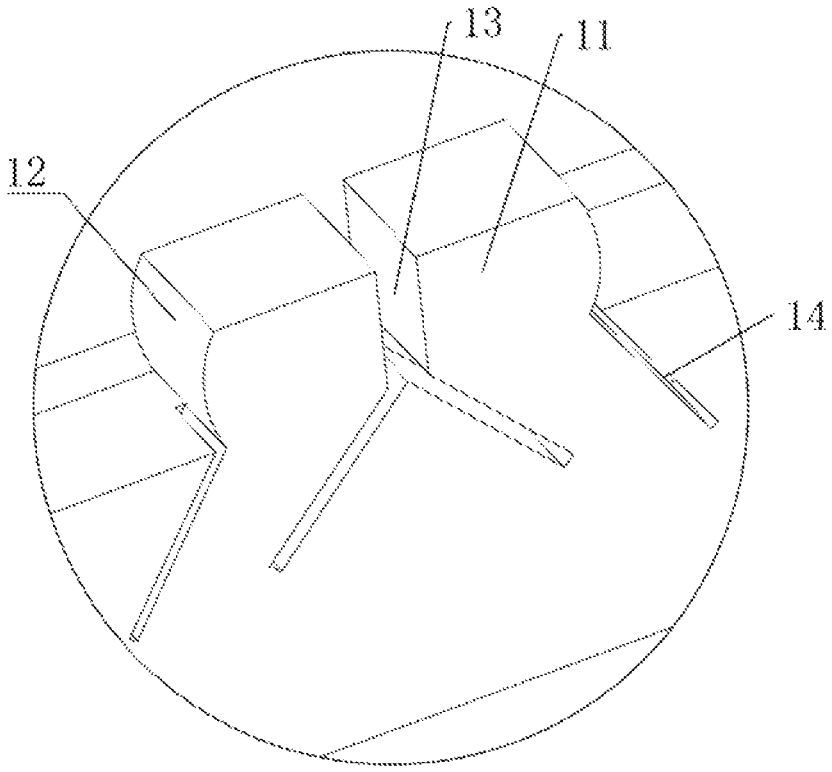
FIG. 4 is an enlarged view of a portion A of the present utility model.

In the description of the present utility model, it should be understood that the direction from a connecting portion 21 to a covering portion 23 in FIG. 3 is the front-rear direction, and the longer end of a holder 1 is in the left-right direction. The terms "upper", "lower", "left", "right", "front", "rear", "inside", "around", etc. indicating orientations or positional relationships are merely used for the purpose of describing the present utility model and simplifying the description, rather than indicate or imply that the indicated assembly or element must have a particular orientation or be constructed and operated in a particular orientation, and are thus not to be understood as limiting the present utility model.

As shown in FIGS. 1-4, an environmentally friendly cosmetic case comprises a holder 1 and a case cover 2 for covering the holder 1, wherein the case cover 2 and the holder 1 are made of a wood material or a bamboo material such that the cosmetic case is more environmentally friendly, and the case cover 2 comprises a connecting portion 21, an elastic portion 22 and a covering portion 23 which are sequentially arranged; when the case cover 2 in the present utility model is unfolded and flattened, the connecting portion 21, the elastic portion 22 and the covering portion 23 are located on the same horizontal plane, and the connecting portion 21, the elastic portion 22 and the covering portion 23 are of an integrally formed structure; the elastic portion 22 is provided with several notches 221 which are arranged at intervals and penetrate upper and lower end faces of the elastic portion 22 such that the elastic portion 22 can be elastically deformed; the connecting portion 21 and the covering portion 23 can both be reversed by the elastic portion 22; and the holder 1 is connected to and arranged at an upper end of the connecting portion 21, and in the present utility mode, the holder 1 is integrally connected to the connecting portion 21 by glue, and the connecting portion 21 is covered at the lower portion of the holder 1.

The front end of the holder 1 is provided with a protrusion 11, and the covering portion 23 is provided with a snap groove 231 that is in snap engagement with the protrusion 11.

The elastic portion 22 is provided with several rows of notches 221 arranged at intervals, the notches 221 between adjacent rows are alternately arranged, and the notch 221 has a triangular cross section and the notches 221 between adjacent rows are arranged in opposite directions. By the above arrangement, the elasticity of the elastic portion 22 is increased, and the elastic portion 22 is easily bent such that the covering portion 23 covers the holder 1.

On two sides of the protrusion 11 are arc portions 12 extending outwardly, and that the arc portions 12 are provided on two sides of the protrusion 11 facilitates the disengagement of the protrusion 11 from the snap groove 231, thereby facilitating opening of the covering portion 23, and that the arc portions 12 extend outwardly facilitates clamping of the protrusion 11 to the snap groove 231.

The protrusion 11 is provided with a dividing groove 13 dividing the protrusion 11 into two parts, the longitudinal section of the dividing groove 13 is of a Y-shaped structure, and a vertical portion of the dividing groove 13 penetrates the protrusion 11, which is convenient to close the protrusion 11 so that the protrusion 11 is disengaged from the snap groove 231; by providing the dividing groove 13, the snap groove 231 presses the protrusion 11 inward when the cosmetic case is closed, and in this state, the protrusions 11 on two sides of the dividing groove will always have opposite acting forces to clamp the snap groove 231, thereby ensuring that the covering portion 23 does not automatically open due to vibration.

Two sides of the protrusion 11 are provided with symmetrical inclined grooves 14, and by adding the inclined grooves 14 on two sides of the protrusion 11, the elasticity of the protrusion 11 when in clamping is effectively improved, such that the protrusion 11 extends outwardly to come into snap engagement with the snap groove 231.

The upper end of the holder 1 is provided with several grooves 15 capable of holding cosmetics; in the present utility model, there are two rows and three columns of small grooves 15 and a large groove 15 in front of the small grooves 15; and with the above arrangement, it is convenient for the holder 1 to hold different types of cosmetics.

The basic working principle of the present utility model is:

1. an environmentally friendly cosmetic case replaces a metal hinge structure with an elastic portion 22 of a case cover 2, thereby reducing the generation of metal waste and the processing procedures of a metal hinge, and since the cosmetic case is made of a wood or bamboo material, the cosmetic case can be degraded by natural microorganisms and is more environmentally friendly, and the cosmetic case having a wooden structure or a bamboo structure can bring a high-end experience effect to consumers;

2. the elastic portion 22 is provided with several rows of notches 221 which are arranged at intervals and alternately, which increases the elasticity of the elastic portion 22, and facilitates bending the elastic portion 22 so that a covering portion 23 covers a holder 1; and 3. that arc portions 12 extending outwardly are provided on two sides of a protrusion 11 facilitates clamping of the protrusion 11 to a snap groove 231; by providing a dividing groove 13, the protrusion 11 is pressed to close when the cover is closed, and in this state, the protrusion 11 always has an opposite acting force to clamp the snap groove 231; by providing inclined grooves 14, the elasticity of the protrusion 11 when in clamping is effectively improved, such that the protrusion 11 extends outwardly to come into snap engagement with the snap groove 231; and through the design of the arc portions 12, the dividing groove 13 and the inclined grooves 14, it is fully ensured that during the transportation, the snap groove 231 does not disengage from the protrusion 11 due to vibration to cause the covering portion 23 to automatically open, thereby protecting the content in the holder 1 from being contaminated.

The above description is merely a preferred embodiment of the present utility model, and all equivalent variations or modifications made to the structures, features and principles described in the scope of the present utility model fall into the scope of the present utility model.

The invention claimed is:

1. An environmentally friendly cosmetic case, comprising:

a holder and a case cover for covering the holder, wherein the case cover comprises a connecting portion, an elastic portion and a covering portion which are sequentially arranged;

the elastic portion can be elastically deformed, and the connecting portion and the covering portion can both be reversed by the elastic portion;

an upper end of the connecting portion is connected to a bottom end of the holder, and the covering portion is used to cover the holder when the cosmetic case is in a closed position; and wherein the holder is provided with a protrusion extending away from the holder and the covering portion is provided with a snap groove, and the snap groove receives the protrusion for snap engagement with the protrusion when the case cover and the holder are moved into the closed position, and wherein the protrusion has an upper groove formed at and extending inward from a distal end of the protrusion to divide the protrusion into two parts and wherein two inner inclined grooves are provided at an inner edge of the upper groove, extending inwards inside the holder and away from each other and forming together with the upper groove an inverted Y-shape, and wherein the snap groove is sized such that when the protrusion is in the snap engagement, the two parts of the protrusion are forced toward each other by the snap groove, and wherein the holder and the case cover are made of a wood or bamboo material.

2. The environmentally friendly cosmetic case according to claim 1, characterized in that: the two sides of the protrusion are arc portions extending outwardly.

3. The environmentally friendly cosmetic case according to claim 1, further comprising: two inclined grooves formed on each side of the protrusion in the holder, each inclined groove of the two inclined grooves being formed adjacent and spaced away from each of the two inner incline grooves and each extending away from each other.

4. The environmentally friendly cosmetic case according to claim 1, characterized in that: the elastic portion is provided with several rows of notches arranged at intervals, the notches between adjacent rows are alternately arranged, and the notches penetrate upper and lower end faces of the elastic portion.

5. The environmentally friendly cosmetic case according to claim 1, characterized in that: when the case cover is unfolded and flattened, the connecting portion, the elastic portion and the covering portion are located on the same horizontal plane.

6. The environmentally friendly cosmetic case according to claim 1, characterized in that: an upper end of the holder is provided with several grooves capable of holding cosmetics.

7. The environmentally friendly cosmetic case according to claim 1, wherein the two inner inclined grooves are symmetric about a center line defined by the upper groove.

8. The environmentally friendly cosmetic case according to claim 7, wherein the two inclined grooves are symmetric about the center line defined by the upper groove.

* * * * *